US011253008B2

(12) United States Patent
Johnson, II

(10) Patent No.: US 11,253,008 B2
(45) Date of Patent: Feb. 22, 2022

(54) GARMENT WITH CONVERTIBLE COLLAR

(71) Applicant: Struck X LLC, Southfiled, MI (US)

(72) Inventor: Charles Anthony Johnson, II, Elizabeth, NJ (US)

( * ) Notice: Subject to any disclaimer, the term of this patent is extended or adjusted under 35 U.S.C. 154(b) by 72 days.

(21) Appl. No.: 16/567,041

(22) Filed: Sep. 11, 2019

(65) Prior Publication Data

US 2020/0000154 A1 Jan. 2, 2020

Related U.S. Application Data

(63) Continuation-in-part of application No. 15/248,040, filed on Aug. 26, 2016, now abandoned.

(51) Int. Cl.
*A41B 3/02* (2006.01)

(52) U.S. Cl.
CPC ..... *A41B 3/02* (2013.01)

(58) Field of Classification Search
CPC .... A41B 3/00; A41B 3/02; A41B 3/06; A41B 3/08; A41B 3/14; A41B 3/16; A41D 25/005; A41D 7/00
USPC ..... 2/141.2, 129, 130, 131, 137, 139
See application file for complete search history.

(56) References Cited

U.S. PATENT DOCUMENTS

| | | | | |
|---|---|---|---|---|
| 1,709,285 | A * | 4/1929 | Slotoroff | A41D 7/00 2/67 |
| 3,088,119 | A * | 5/1963 | Grant | A41D 23/00 2/207 |
| 3,509,580 | A * | 5/1970 | Rubenstein | A41D 15/00 2/65 |
| 7,086,092 | B1 * | 8/2006 | Cruz | A41B 3/04 2/132 |
| 9,936,748 | B1 * | 4/2018 | Pinto | A41D 23/00 |
| 2016/0165980 | A1 * | 6/2016 | Harrison | A41B 15/02 2/145 |

* cited by examiner

*Primary Examiner* — Timothy K Trieu
(74) *Attorney, Agent, or Firm* — Kristin Grant; Grany Attorneys at Law PLLC

(57) ABSTRACT

A garment with a convertible collar comprising of a body having a neck opening and a garment collar secured to the neck opening of the body, the garment collar comprising of a first extension comprising of a connector, the connector comprising of two or more corresponding parts, and a second extension comprising of a connector, the connector comprising of two or more corresponding parts, wherein the connector is detachable from the garment collar.

6 Claims, 12 Drawing Sheets

GARMENT WITH CONVERTIBLE COLLAR

CROSS REFERENCE TO RELATED APPLICATIONS

This application is a continuation-in-part of application Ser. No. 15/248,040, filed on Aug. 26, 2016.

BACKGROUND

Field of the Invention

The present invention is directed to a garment having a collar, and more particularly to a garment having a collar where the collar can be converted into a plurality of styles.

Related Art

Garments with convertible collars are well known in the apparel industry and were generally created with the intent of adding versatility to a garment. For example U.S. Pat. No. 2,810,130A discloses a means for securing a convertible collar where such securing means is concealed, and U.S. Pat. No. 1,709,285A discloses a bathing garment having a convertible collar where the collar may either be worn in an open or closed style. Both of these patents disclose garments with convertible collars, however the number of styles that these collars can form are limited.

The present invention provides a stylish garment with a convertible collar. Distinct from other convertible collar garments, the convertible collar in the present invention comprises of connectors specifically and discreetly placed such that the garment can be converted into a plurality of styles, thereby maintaining appeal as a wardrobe staple season after season without looking dated.

SUMMARY OF THE INVENTION

It is to be understood that the phraseology and terminology employed herein are for the purpose of the description and should not be regarded as limiting.

The present invention is directed to a garment having a convertible collar providing the wearer with a number of versatile looks, comprising of a first extension with a connector and a second extension with a connector. The connectors each comprising of two or more corresponding parts for securing the first extension and the second extension to each other and to other parts of the garment when the collar is manipulated into a particular style. These and other features of the present invention will become readily apparent upon further review of the specification and drawings.

BRIEF DESCRIPTION OF THE DRAWINGS

Embodiments of the present invention will be described by way of example only, and not limitation, with reference to the accompanying drawings in which.

DETAILED DESCRIPTION

Figure 1:
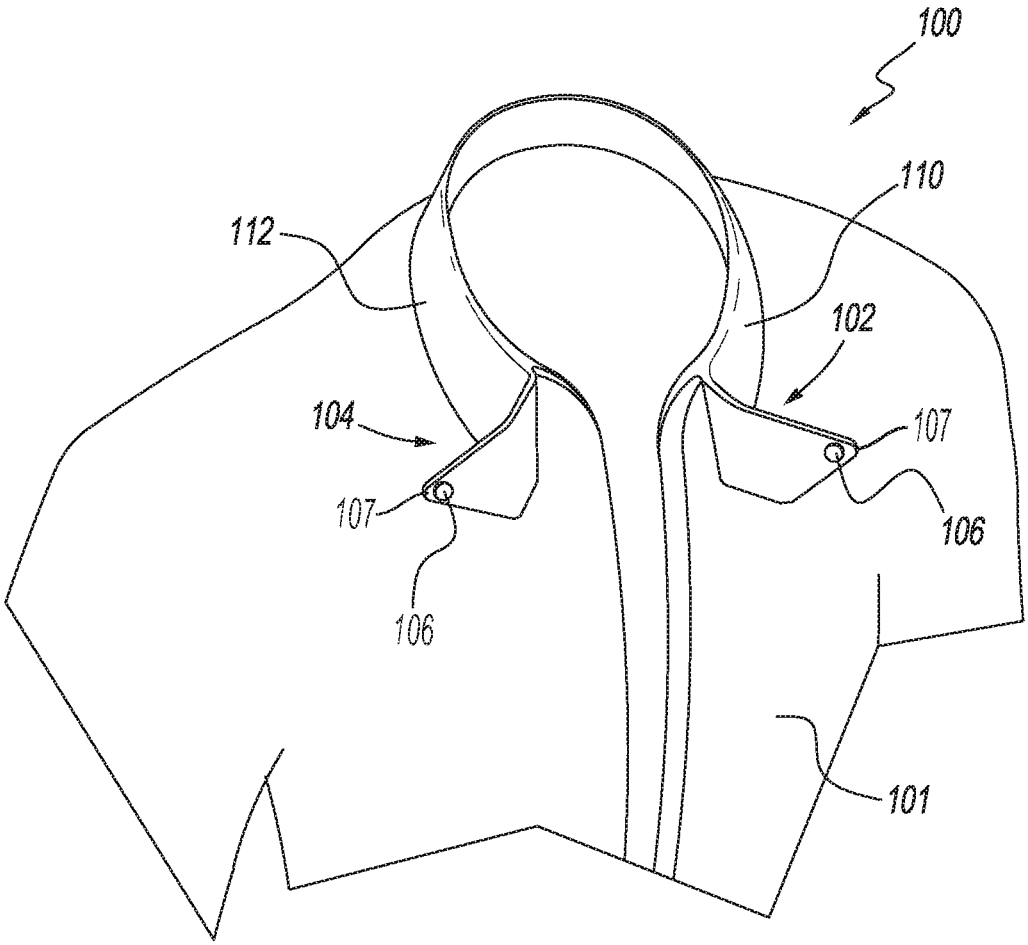
FIG. 1 is a perspective view of a garment with a convertible collar according to an embodiment of the present invention.

Referring now to the figures, where similar reference characters denote similar elements throughout, FIG. 1 and FIGS. 3 through 12 show perspective views of a garment with a convertible collar 100 according to an embodiment of the present invention, the convertible collar comprising of a first extension 102, a second extension 104, and a neck length portion 110. The first extension 102 and the second extension 104 each having a tip 107, a base 105, and a connector 106, the connector 106 comprising of two or more corresponding parts. The connector 106 preferably comprising of magnets but may comprise of male and female connectors and fasteners, hook and eye fasteners, hook and loop fasteners, buttons, or other similar connectors commonly known in the art for securing a first extension and the second extension to one another or to other areas on a convertible collar when the convertible collar is manipulated into different styles. One or more parts of the connector 106 are on the tip 107 of the first extension 102 and one or more parts of the connector 106 are on the base 105 of the first extension 102 (shown in FIG. 2). All of the one or more corresponding parts of the connector 106 are detachable or removable from the convertible collar 100.

Figure 2:
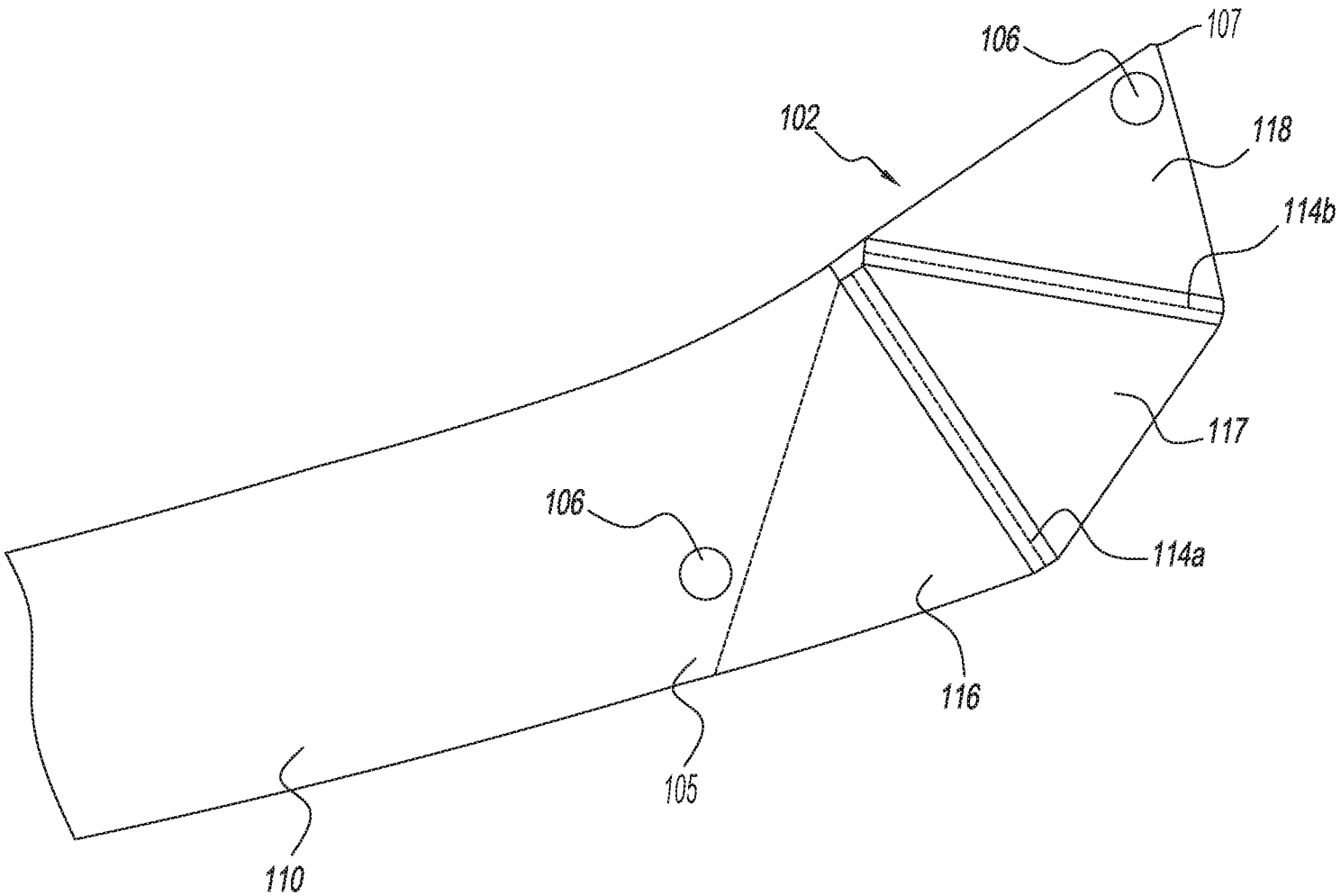
FIG. 2 is a front view of a sewing pattern for half of a convertible collar according to an embodiment of the present invention.

FIG. 2 shows a front view of a sewing pattern for half of a convertible collar 100 according to an embodiment of the present invention. The pattern comprising of half of a neck length portion 110 and a first extension 102 extending from the half of the neck length portion 110. The first extension 102 having a tip 107 and a base 105 where the base 105 is the area where the neck length portion 110 meets the first extension 102 and the tip 107 is at the end of the first extension 102 distal from the neck length portion 110. In the sewing pattern, the first extension comprising three triangles 116, 117, 118, one part of the connector 106 is illustrated at the tip 107, and one part of the connector 106 is illustrated at the base 105. The one part of the connector 106 at the base 105 is located directly outside of the first triangle 116 at a distance away from the bottom of the first triangle 116 of between 0 to ½ of the length of the side of the first triangle 116. There is an ease 114*a* preferably measuring approximately ¼ inch in between triangle one 116 and triangle two 117 and there is an ease 114*b* preferably measuring approximately ¼ inch in between triangle two 117 and triangle three 118, the ease 114*a*, 114*b* providing accountability for length lost as a result of folding, such that the folding does not reduce the preferred length of the extensions 102, 104. In a size medium garment with standard measurements of the typical size medium wearer, the triangles 116, 117, 118 preferably have a base width of approximately 2¾ inches. The sewing pattern, as shown in FIG. 2 is graded up and down according to grading techniques typically known in the art. The extensions 102, 104 extend beyond the typical length of a collar. By way of example only, comparing a men's dress shirt in size large—the extensions 102, 104 of the convertible collar preferably extending 6.75 inches beyond a typical men's size large collar which measures 16.5 inches in length. However, the extensions 102, 104 may extend between 65% and 75% longer than the length of a standard length collar in any respective size. This range provides the optimal length for creating a plurality of styles. The sewing pattern for the other half of the convertible collar 100 is a mirror image of the sewing pattern for this half of the convertible collar 100, however the first extension 102 in the sewing pattern for this half of the convertible collar 100 shown in FIG. 2 would be identified as the second extension 104 in the sewing pattern for the other half of the convertible collar 100 (not shown).

In a preferred embodiment of the present invention the convertible collar 100 is detachable or removable from the garment 101. Attachment/detachment means may comprise of hook and loop fasteners, magnets, adhesive, or other similar attachment means generally known in the art. Where the connector comprises of magnets, attachment/removal means may comprise of openings at each of the tips and the bases for securely holding the connector, the connector being completely hidden when inserted into the openings. In an embodiment of the present invention the first extension 102 and the second extension 104 are detachable from the neck length portion 110. Attachment/detachment means may comprise of hook and eye fasteners, hook and loop fasteners, buttons, snaps, magnets, adhesive, or other similar attachment means generally known in the art.

Figure 3:
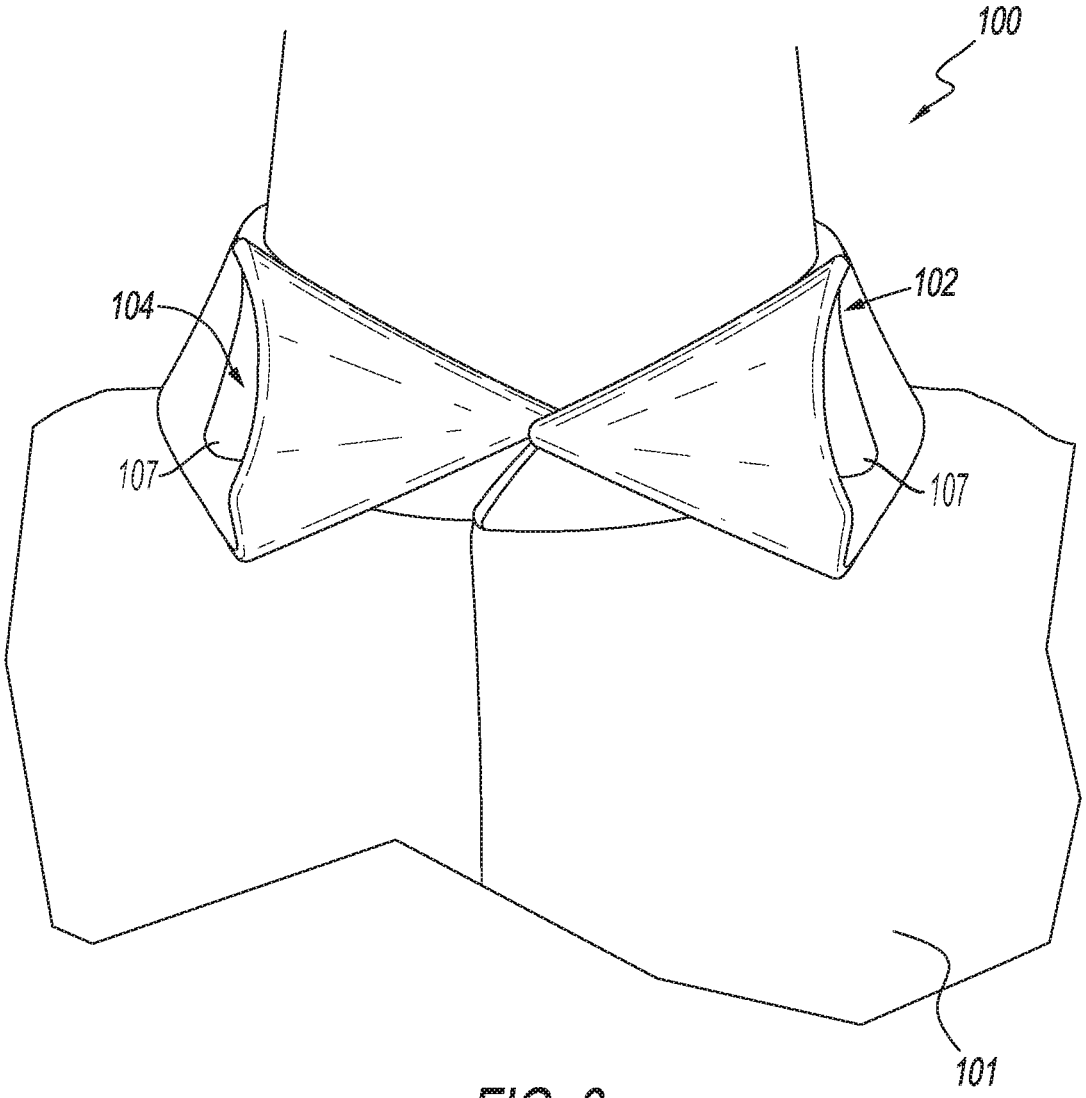
FIG. 3 is a perspective view of a garment with a convertible collar arranged in a bowtie style according to an embodiment of the present invention.

FIGS. 3 through 12 show perspective views of a garment 101 with convertible collar 100 according to the present invention where the collar is converted into a variety of styles. By way of example only, where style names are used for ease of reference and are not intended to be limiting, FIG. 3 is a perspective view of a garment 101 with a convertible collar 100 where the collar is in a bowtie style. The bowtie is formed by folding the first extension 102 and the second extension 104 upwards and into the wearer's body, connecting the one or more parts of the connector 106 on the tips 107 to the one or more parts of the connector on the bases 105.

Figure 4:
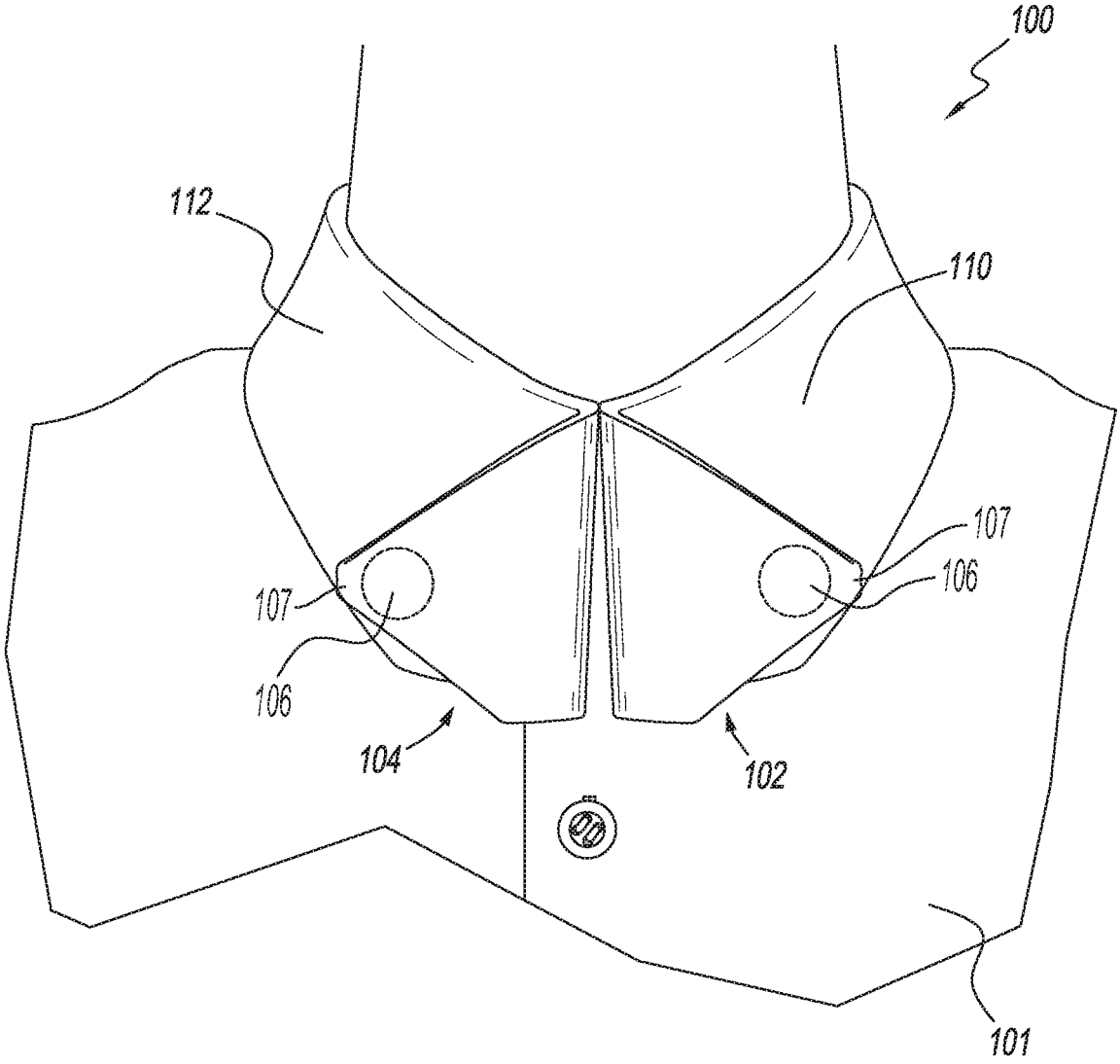
FIG. 4 is a perspective view of a garment with a convertible collar arranged in a wing spread style according to an embodiment of the present invention.

FIG. 4 is a perspective view of a garment 101 with a convertible collar 100 where the collar is in a wing spread style. The wing spread collar is formed by folding the first extension 102 and the second extension 104 backwards, away from the center of the wearer's neck, connecting the one or more parts of the connector 106 on the tips 107 to the one or more parts of the connector 106 on the bases 105.

Figure 5:
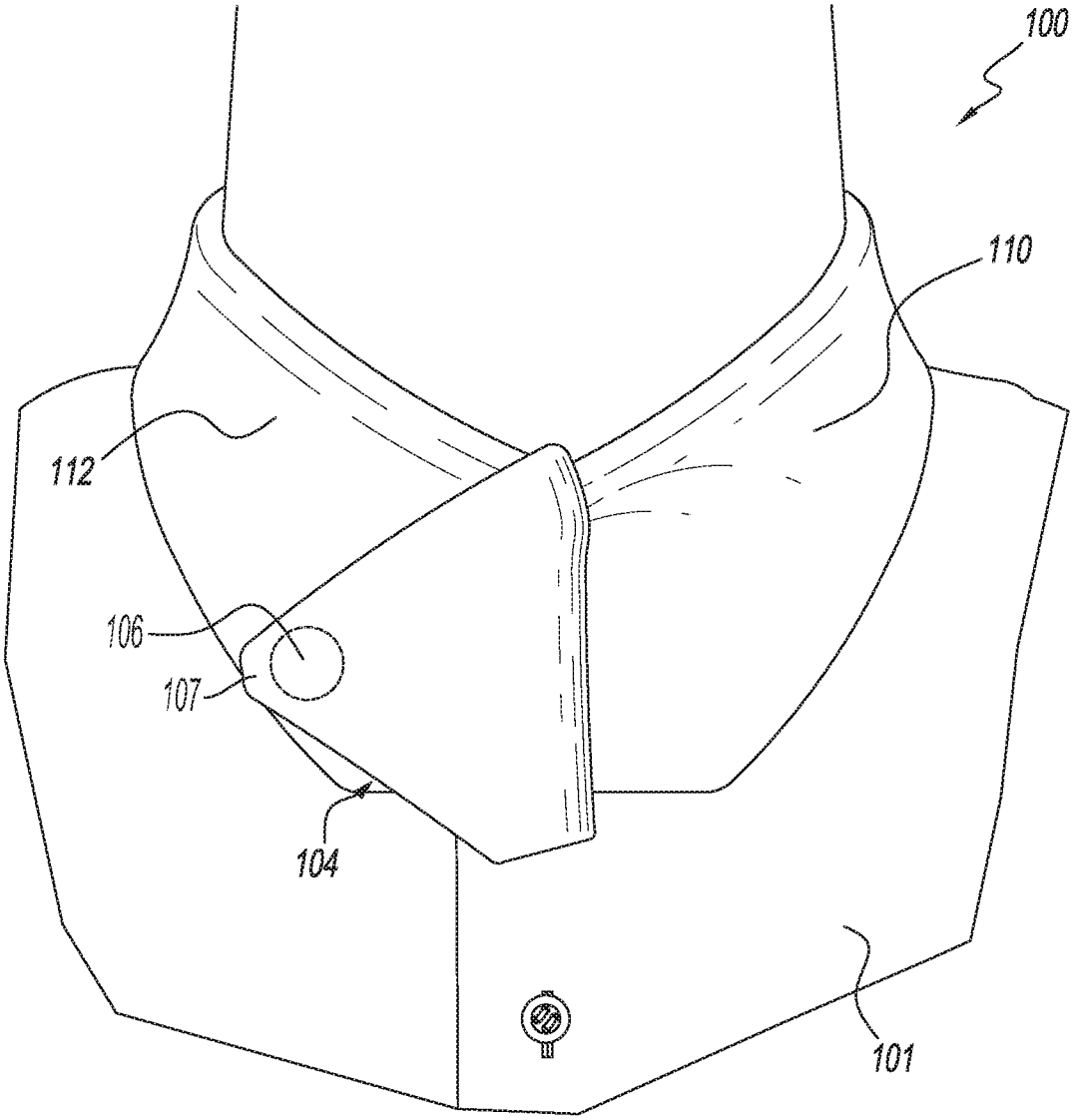
FIG. 5 is a perspective view of a garment with a convertible collar arranged in a slice style according to an embodiment of the present invention.

FIG. 5 is a perspective view of a garment 101 with a convertible collar 100 where the collar is in a slice style. The slice collar is formed by extending the first extension 102 across the wearer's neck, connecting the one or more parts of the connector 106 on the tip 107 of the first extension 102 with the one or more parts of the connector 106 on the base 105 of the second extension 104, folding the tip 107 of the second extension 104 backwards, away from the center of the wearer's neck such that the tip 107 of the second extension 104 is pointing towards the wearer's shoulder.

Figure 6:
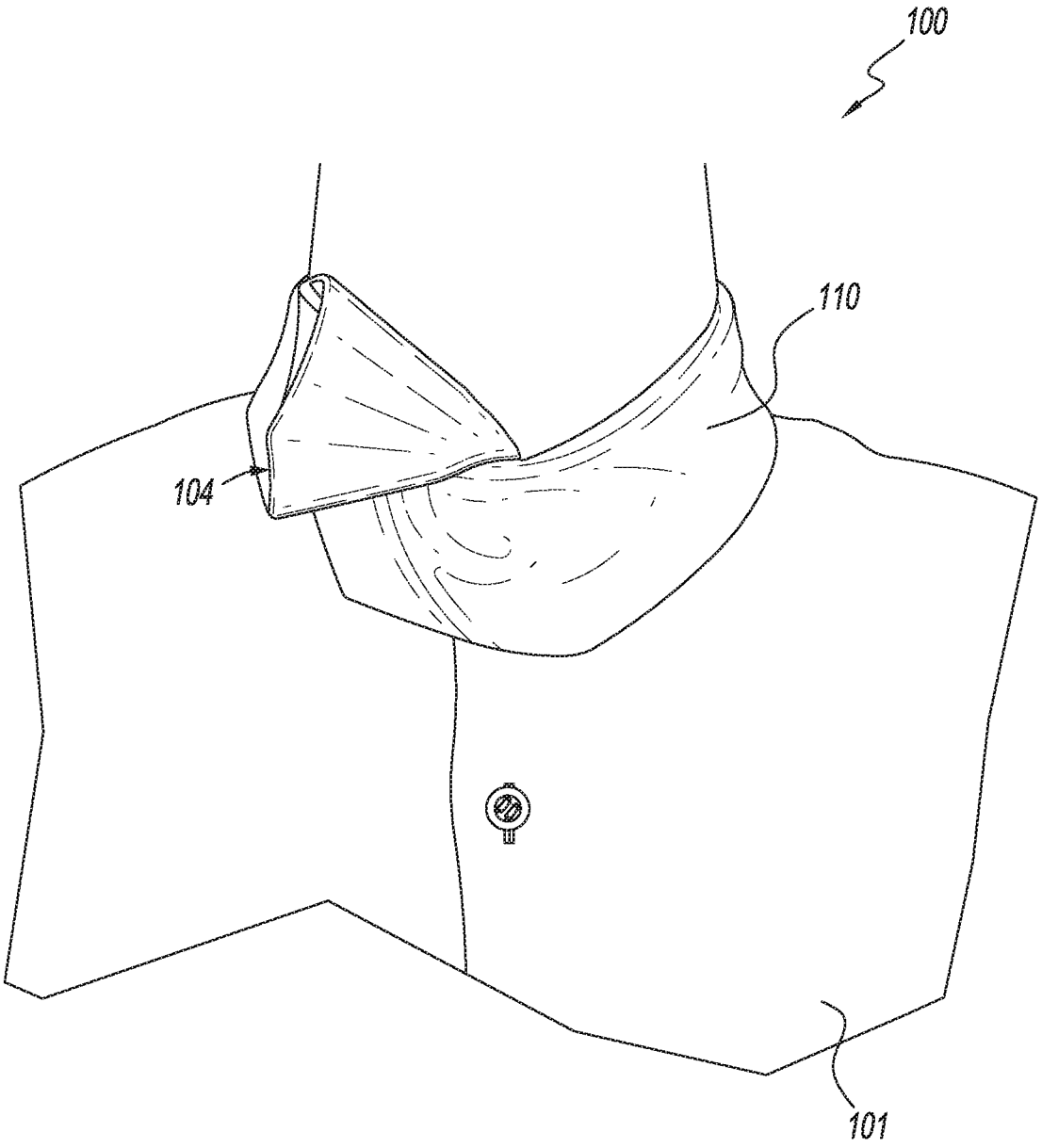
FIG. 6 is a perspective view of a garment with a convertible collar arranged in a half bowtie style according to an embodiment of the present invention.

FIG. 6 shows a garment 101 with a convertible collar 100 where the collar is in a half bowtie style. The half bowtie is formed by extending the first extension 102 across the wearer's neck, connecting the one or more parts of the connector 106 on the tip 107 of the first extension 102 with the one or more parts of the connector 106 on the base 105 of the second extension 104, folding the tip 107 of the second extension 104 upwards and into the wearer's body, connecting the one or more parts of the connector 106 on the tip 307 of the second extension 104 to the one or more parts of the connector 106 on either the base 105 of the second extension 104 or on the tip 107 of the first extension 102.

Figure 7:
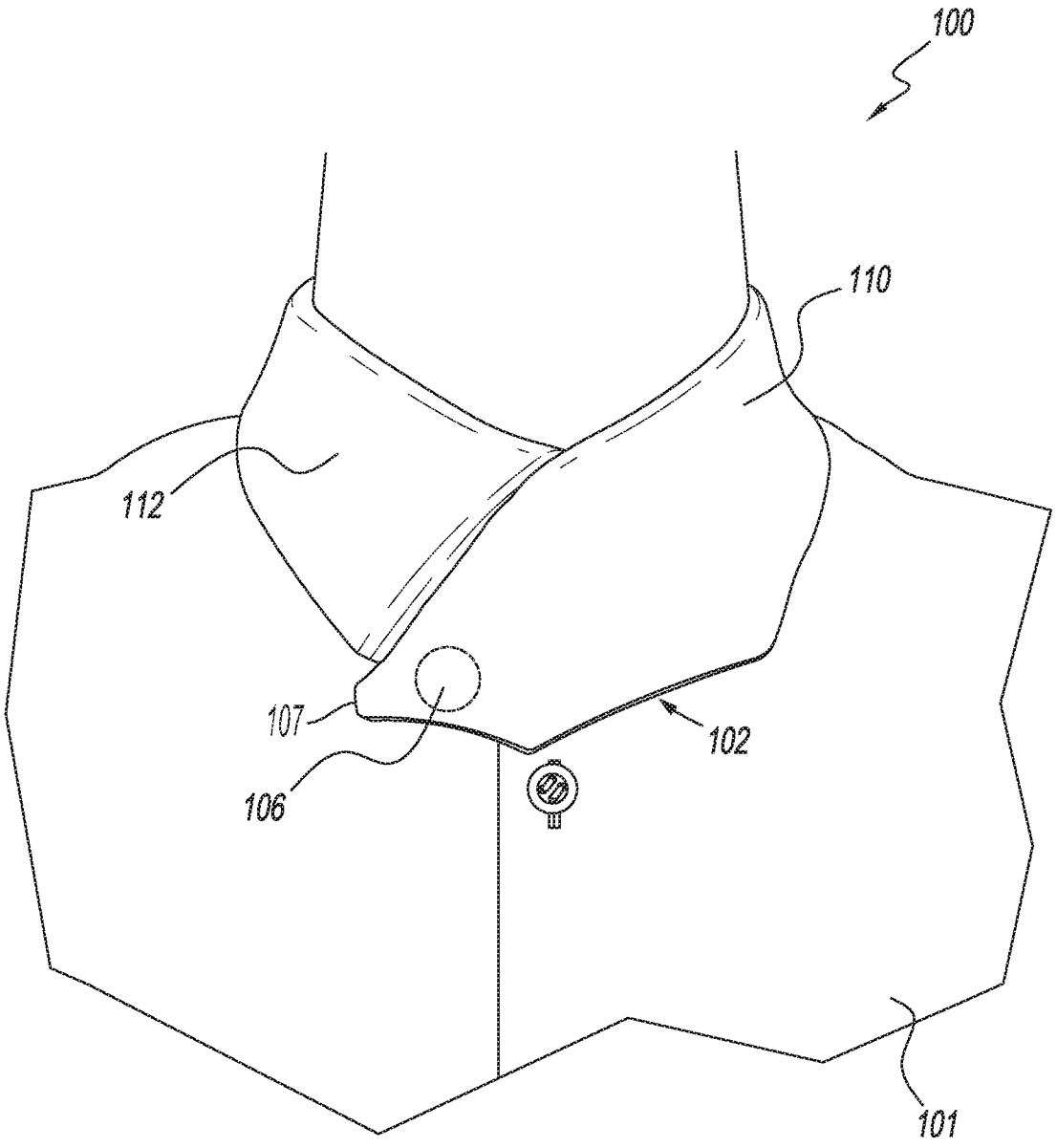
FIG. 7 is a perspective view of a garment with a convertible collar arranged in a wing wrap style according to an embodiment of the present invention.

FIG. 7 is a perspective view of a garment 101 with a convertible collar 100 where the collar is in a wing wrap style. The wing wrap collar is formed by folding the second extension 104 inward and under the neck length 110, connecting the one or more parts of the connector 106 on the tip 107 of the second extension 102 to the one or more parts of the connector 106 on the base of the second extension 104. Extending the first extension 102 downwards and towards the center of the wearer's body.

Figure 8:
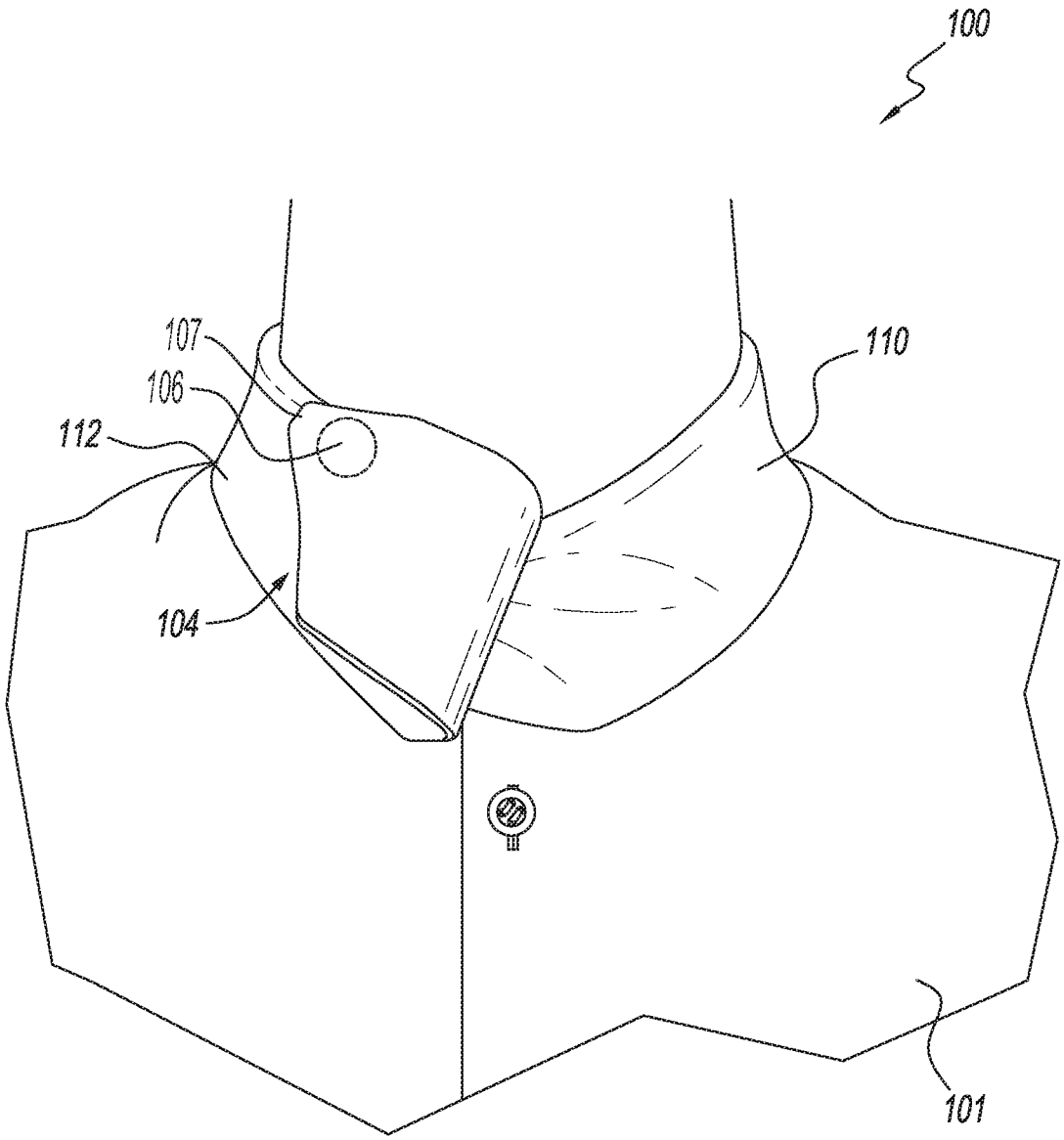
FIG. 8 is a perspective view of a garment with a convertible collar arranged in a wing fold style according to an embodiment of the present invention.

FIG. 8 shows a garment 101 with a convertible collar 100 where the collar is in a wing fold style. The wing fold collar is formed by extending the first extension 102 across the wearer's neck, connecting the one or more parts of the connector 106 on the tip 107 of the first extension 102 with the one or more pans of the connector 106 on the base 105 of the second extension 104, folding the tip of the second extension 104 backwards, away from the center of the wearer's neck, connecting the one or more parts of the connector 106 on the tip 107 of the second extension 104 to the one or more parts of the connector 106 on the base 105 of the second extension 104.

Figure 9:
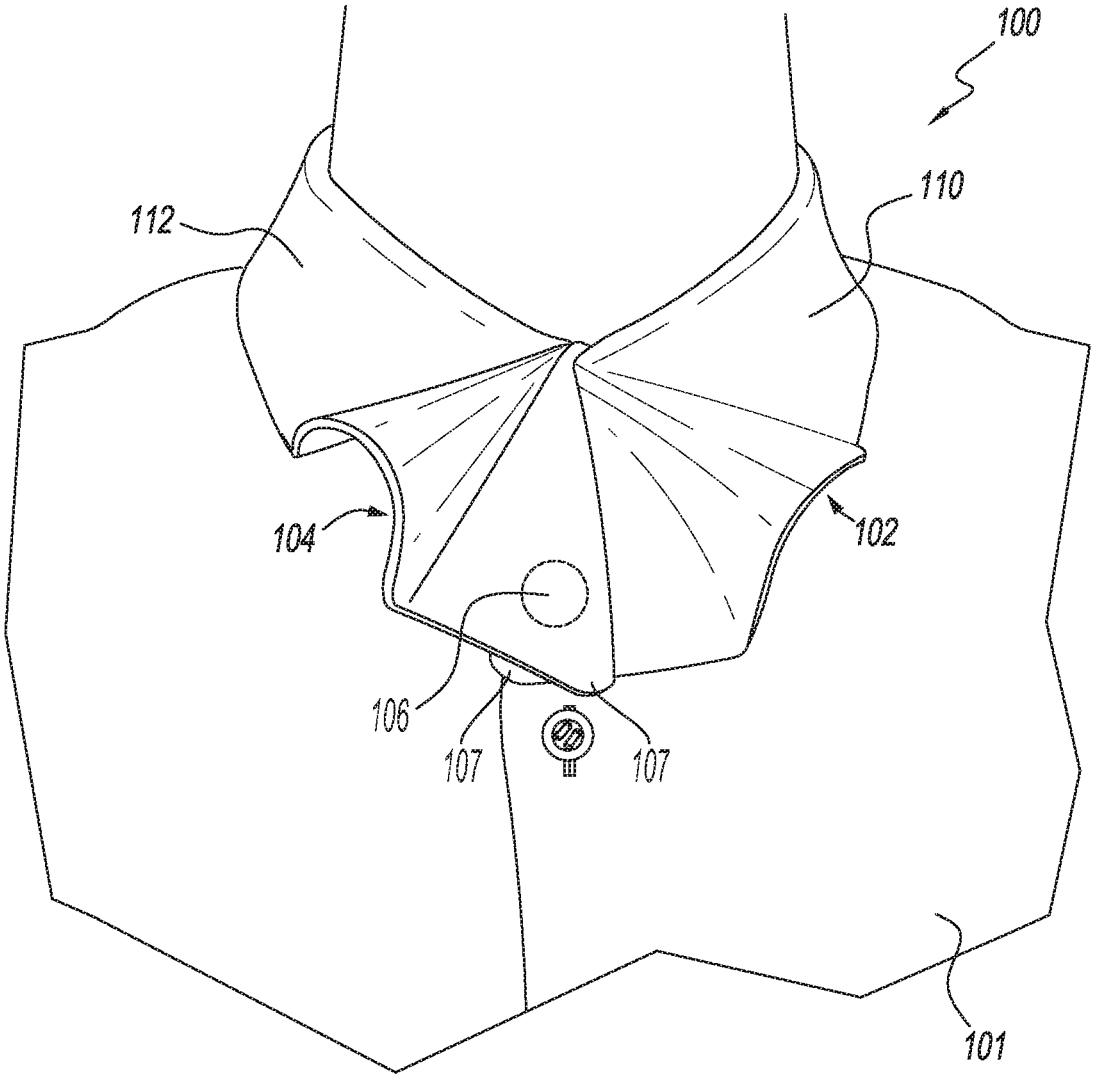
FIG. 9 is a perspective view of a garment with a convertible collar arranged in a ripple style according to an embodiment of the present invention.

FIG. 9 shows a garment 101 with a convertible collar 100 where the collar is in a ripple style. The ripple collar is formed by holding the tips 107 of the extensions 102, 104 and pushing them upwards and towards the wearer's body until the one or more parts of the connector 106 on each tip 107 are in contact, thereafter connecting the one or more parts of the connector 106 on each tip 107.

Figure 10:
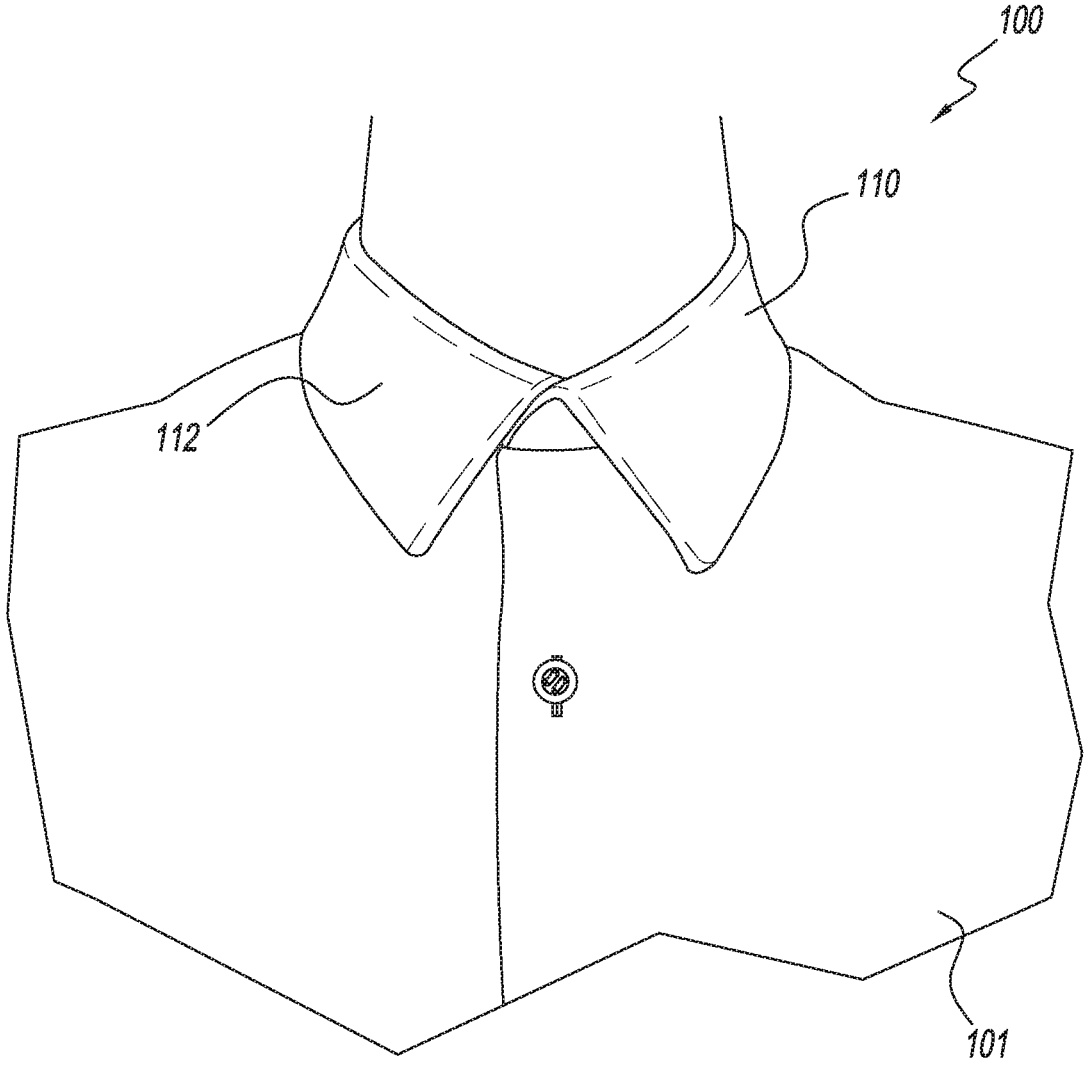
FIG. 10 is a perspective view of a garment with a convertible collar arranged in a standard style according to an embodiment of the present invention.

FIG. 10 shows a garment 101 with a convertible collar 100 where the collar is in a standard style. The standard collar is formed by folding the tips of the extensions inwardly and under the neck lengths 110, 112, connecting the one or more parts of the connectors 106 on the tips 107 to the one or more parts of the connectors 106 on the bases 105.

Figure 11:
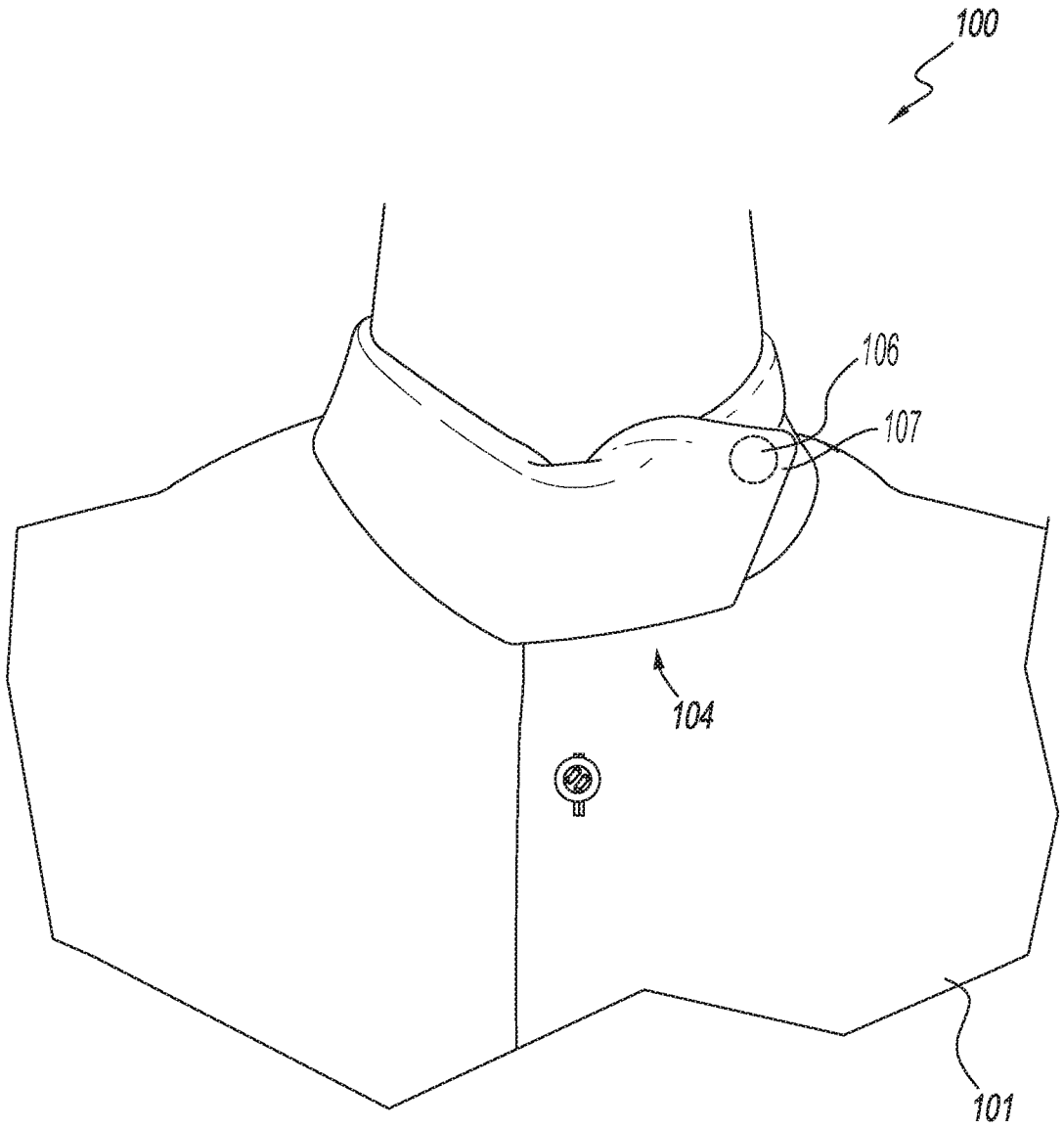
FIG. 11 is a perspective view of a garment with a convertible collar arranged in a clergy style according to an embodiment of the present invention.

FIG. 11 shows a garment 101 with a convertible collar 100 where the collar is in a clergy style. The clergy collar is formed by extending the first extension 102 across the wearer's neck, connecting the one or more parts of the connector 106 on the tip 107 of first extension 102 with the one or more parts of the connector 106 on the base 105 of the second extension 104, and extending the second extension 104 across the wearer's neck over the first extension 102, connecting the one or more parts on the connector 106 on the tip 107 of the second extension 104 with the one or more parts of the connector 106 on the base 105 of the first extension 102.

Figure 12:
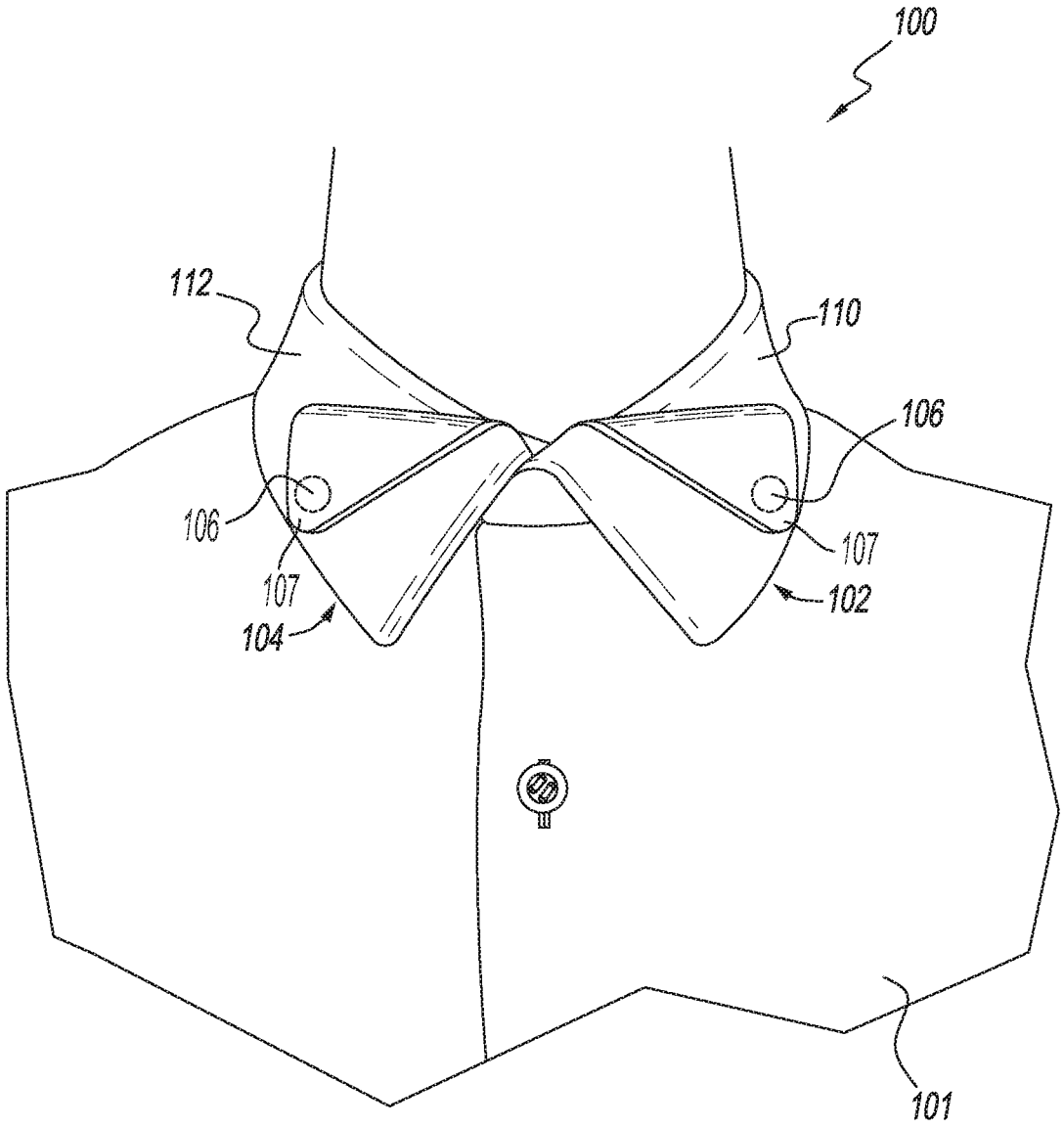
FIG. 12 is a perspective view of a garment with a convertible collar arranged in a wing tip style according to an embodiment of the present invention.

FIG. 12 shows a garment 101 with a convertible collar 100 where the collar is in a wing-tip style. The wing-tip collar is formed by folding the extensions 102, 104 upwards, thereafter folding only the tips 107 of the extensions 102, 104 downwards thereby connecting the one or more parts of the connectors 106 on the tips 107 to the one or more parts of the connectors 106 on the bases 105.

It is to be understood that the present invention is not limited to the embodiments described above but encompasses any and all embodiments within the scope of the following claims.

What is claimed is:

1. A garment collar comprising:

a. two horizontally adjacent neck length portions permanently connected to form a single structure, the single structure comprising the neck length portions having two parallel vertical sides flanking and perpendicular to two parallel elongated horizontal sides, wherein one of the horizontal sides is configured to be affixed onto an entire length of a neck opening of a garment, the horizontal sides not extending horizontally beyond the vertical sides;

b. a first extension having a tip and a base, wherein the tip of the first extension is distal from the base of the first extension and the first extension is connected to a first or the two vertical sides of the single structure comprising the neck length portions at the base of the first extension, and wherein the width of a portion of the first extension that includes the base is at least equal to the width of the neck length portions; and c. a second extension having a tip and a base, wherein the tip of the second extension is distal from the base of the second extension and the second extension is connected to a second of the two vertical sides of the single structure comprising the neck length portions at the base of the second extension, and wherein the width of a portion of the second extension that includes the base is at least equal to the width of the neck length portions;

d. the first extension and the second extension each comprising of a connector, the connectors each comprising of two or more corresponding parts, wherein the two or more corresponding parts of the connectors are equally divided on the tips and the bases and wherein each of the two or more corresponding parts of the connectors are detachable from the collar;

e. the first extension and the second extension each measuring between 65% and 75% longer than the length of a standard collar size wherein the length of the standard collar is one of 13.5 inches, 14.5 inches, 15.5 inches 16.5 inches, 17.5 inches and 18.5 inches;

f. the garment collar constructed using a sewing pattern, wherein the portions of the sewing pattern for constructing the extensions each comprising a first triangle adjacent to a second triangle the first triangle connected to the second triangle by an ease, and a third triangle adjacent to the second triangle the this triangle connected to the second triangle by an ease.

2. The garment collar of claim 1, wherein the connector comprises of magnets.

3. The garment of claim 2, wherein each of the tips and the bases further comprise of an opening for securely holding the connector, the connector completely hidden when inserted into the opening.

4. A garment with a convertible collar comprising:

a. a body having a neck opening for receiving a wearer's neck and two openings one on either side of the body for receiving a wearer's arms; and b. a garment collar attached to the neck opening of the body, the garment collar comprising:

i. two horizontally adjacent neck length portions permanently connected to form a single structure, wherein the single structure comprising the neck length portions is parallel to the neck opening of the body, the single structure comprising the neck length portions having two parallel vertical sides flanking and perpendicular to two parallel elongated horizontal sides, wherein one of the horizontal sides is affixed into the length of the neck opening of the body, the horizontal sides not extending horizontally beyond the vertical sides;

ii. a first extension having a tip and a base, wherein the tip of the first extension is distal from the base of the first extension and the first extension is connected to one of the two vertical sides of the single structure comprising the neck length portions at the base of the first extension, and wherein the width of a portion of the first extension that includes the base is at least equal to the width of the neck length portions; and a second extension having a tip and a base, wherein the tip of the second extension is distal from the base of the second extension and the second extension is connected to a second of the two vertical sides of the single structure comprising, the neck length portions at the base of the second extension, and wherein the width of a portion of the first extension that includes the base is at least equal to the width of the neck length portions;

iv. the first extension and the second extension each comprising of a connector, the connectors each comprising of two or more corresponding pans, wherein the two or more corresponding parts of the connectors are equally divided on the tips and the bases and wherein each of the two or more corresponding parts of the connectors are detachable from the extensions; and v. the first extension and the second extension each measuring between 65% and 75% longer than the length of a standard collar in its respective size, wherein the length of the standard collar is 13.5 inches, 14.5 inches, 15.5 inches 16.5 inches, 17.5 inches and 18.5 inches;

vi. the garment collar constructed using a sewing pattern, wherein the portions of the sewing pattern for constructing the extensions each comprising a first triangle adjacent to a second triangle the first triangle connected to the second triangle by an ease, and a third triangle adjacent to the second triangle the third triangle connected to the second triangle by an ease.

5. The garment of claim 4, wherein the connector comprises of magnets.

6. The garment collar of claim 5, wherein each of the tips and the bases further comprise of an opening for securely holding the connector, the connector completely bidden when inserted into the opening.

* * * * *